US007527259B2

(12) United States Patent
Meetze, Jr. et al.

(10) Patent No.: US 7,527,259 B2
(45) Date of Patent: May 5, 2009

(54) SIMPLIFIED MOVEMENT PRINTER SHEET STACK EDGE GUIDE

(75) Inventors: Murray O. Meetze, Jr., Rochester, NY (US); David K. Young, Fairport, NY (US); Kenneth J. Rieck, Victor, NY (US)

(73) Assignee: Xerox Corporation, Norwalk, CT (US)

( * ) Notice: Subject to any disclaimer, the term of this patent is extended or adjusted under 35 U.S.C. 154(b) by 29 days.

(21) Appl. No.: 11/476,542

(22) Filed: Jun. 28, 2006

(65) Prior Publication Data

US 2008/0001346 A1 Jan. 3, 2008

(51) Int. Cl.
*B65H 1/00* (2006.01)

(52) U.S. Cl. ..... 271/171

(58) Field of Classification Search ..... 271/171; 399/393

See application file for complete search history.

(56) References Cited

U.S. PATENT DOCUMENTS

| | | | | |
|---|---|---|---|---|
| 5,188,351 | A | 2/1993 | Gysling | |
| 5,328,166 | A | 7/1994 | Hokamura | |
| 5,360,207 | A | 11/1994 | Rauen et al. | |
| 5,511,771 | A | 4/1996 | Rubscha | |
| 5,611,528 | A | 3/1997 | Nakamura et al. | |
| 5,945,527 | A | 8/1999 | Tu et al. | |
| 6,302,390 | B1 | 10/2001 | Clark et al. | |
| 6,523,822 | B1 * | 2/2003 | Galtier et al. | 271/171 |
| 6,775,514 | B2 | 8/2004 | Korhonen | |
| 6,845,977 | B2 | 1/2005 | Leveto et al. | |
| 2003/0047864 | A1 * | 3/2003 | Nakamura et al. | 271/162 |
| 2003/0180078 | A1 | 9/2003 | Lynn et al. | |
| 2006/0087072 | A1 * | 4/2006 | Kwon et al. | 271/171 |

FOREIGN PATENT DOCUMENTS

| | | | |
|---|---|---|---|
| JP | 3-133837 | * | 6/1991 |
| JP | 6-32468 | * | 2/1994 |
| JP | 6-115716 | * | 4/1994 |
| JP | 8-268570 | * | 10/1996 |
| JP | 11-139573 | * | 5/1999 |
| JP | 2001-187642 | * | 7/2001 |

* cited by examiner

*Primary Examiner*—Patrick Mackey
*Assistant Examiner*—Thomas A Morrison
(74) *Attorney, Agent, or Firm*—Fay Sharpe LLP

(57) ABSTRACT

A more intuitive and easier to use repositionable sheet stack edge guide, in which a single simple manual movement of a single visible upstanding member in either of the opposite possible repositioning directions can both automatically unlatch the edge guide latching system from its previously latched position by the partial pivoting of that member and also move the edge guide in its desired repositioning direction.

3 Claims, 6 Drawing Sheets

SIMPLIFIED MOVEMENT PRINTER SHEET STACK EDGE GUIDE

Most printers have sheet stacking trays adapted for stacking different desired sizes of print media sheets. To allow for different sizes of print media sheets to be fed from the same tray they are typically provided with one or more upstanding repositionable stack edge guides (stack side and/or end guides) which are repositionable towards or away from a desired stack edge position to fit the dimensions of the sheets being stacked therein. Surprisingly, considering the extent of this art, many such stack edge guides are still somewhat awkward and non-intuitive to reposition. For example, various present edge guides require the user to first pinch two members together to unlatch the edge guide and then require a second and separate movement to reposition the edge guide (linearly slide it along its mounting track) while maintaining that pinching. That is, two different and simultaneous manual actions are required to adjust a paper tray for different sizes of paper—squeezing as well as pushing or pulling. Some other stack edge guides can both release a latch and move the guide in the same direction by pushing on a lever, but only in one direction, and confusingly cannot do so in the opposite direction.

In contrast, disclosed in the embodiments herein is a more intuitive and easier to use repositionable edge guide. A finger or hand movement of a single visible member in the desired repositioning movement direction of an upstanding visible lever can desirably both unlatch the edge guide and move the edge guide in the desired direction. Mere single finger pushing of a single lever in the desired stack edge guide movement direction is sufficient. This is much more intuitive for the casual user and less prone to accidental damage. Easier to operate manual devices are also desirable in general in view of the Americans with Disabilities Act or ADA (sometimes also referred to as Section 508) or other regulations. The disclosed embodiments operate with only a simple push or pull in one direction. No squeezing or other separate manual effort is required for unlatching, and automatic latching in the desired stack edge guide movement release position can be provided.

Of background art interest some general examples in numerical order are noted of the numerous Xerox Corp. U.S. Patents on various stack edge guides and their movement arrangements, incorporated by reference herein: 5,188,351; 5,328,166; 5,360,207; 5,511,771; 5,945,527; 6,302,390 B1; 6,775,514 B2; 6,845,977 B2 and U.S. Application Publication No. US 2003/0180078 A1, published Sep. 25, 2003 to Lynn et al. Also noted is Mita U.S. Pat. No. 5,611,528, issued Mar. 18, 1997 to Nakamura et al.

A specific feature of the specific embodiment disclosed herein is to provide a print media sheets stacking tray with at least one upstanding repositionable stack edge guide which is repositionable in said sheet stacking tray in at least two opposite movement directions for different sizes of print media sheets, wherein said print media sheet stacking tray has plural latching positions and wherein said repositionable upstanding stack edge guide includes a latching system for engaging said repositionable stack edge guide in a selected said latching position; the improvement comprising an integrated latch disengaging system and stack edge guide repositioning system on said stack edge guide with an upstanding lever arm which is manually moveable in both of said opposite repositioning movement directions of said stack edge guide and operatively connected to said latching system so that both of said opposite movement directions of said single upstanding lever arm disengage said stack edge guide latching system from said selected latching position and reposition said repositionable stack edge guide in a selected one of said two opposite movement directions with the same manual movement of said upstanding lever arm in the same direction.

Further specific features disclosed in the embodiment herein, individually or in combination, include those wherein plural latching positions are defined by an elongated array of multiple spaced latches, at least one of which is normally engaged by a latch engagement tab on said repositionable stack edge guide, and wherein said upstanding lever arm is pivotally mounted to said repositionable stack edge guide, and wherein said latch engagement tab is lifted away from said multiple spaced latches by said pivoting of said upstanding lever arm when said upstanding lever arm is manually moved in either of said two opposite movement directions; and/or wherein said upstanding lever arm has two different spaced apart pivot areas which respectively operatively connect to unlatch said latching system in both of said two opposite movement directions of said upstanding lever arm; and/or wherein a flexible member is connected between said stack edge guide and said upstanding lever arm and wherein said two different spaced apart pivot areas are on opposite sides of said flexible member, and a latch engagement surface is provided intermediately of said flexible member; and/or wherein said upstanding lever arm is partially pivotal and has two different spaced apart pivot areas which respectively operatively connect to said latching system to unlatch said latching system in both of said two opposite movement directions of said upstanding lever arm by pivoting a respective one of said two different spaced apart pivot areas against a camming surface on said stack edge guide to lift a latch engagement surface; and/or wherein said stack edge guide includes a latching system normally automatically holding said stack edge guide latched in position and an upstanding member which is manually partially pivotal in both of said opposite repositioning movement directions of said stack edge guide and operatively connected to said latching system, with a single movement of said upstanding member in said first direction automatically pivoting said upstanding member in said first direction to unlatch said latching system and repositioning said stack edge guide in said first direction, with a single movement of said upstanding member in said second direction automatically pivoting said upstanding member in said second direction to unlatch said latching system and repositioning said stack edge guide in said second direction, and automatically latching said latching system in the absence of said pivotal movement of said upstanding member.

The term "reproduction apparatus" or "printer" as used herein broadly encompasses various printers, copiers or multifunction machines or systems, xerographic or otherwise. The term "sheet" herein refers to a usually flimsy physical sheet of paper, plastic, or other suitable physical substrate for images, whether precut or web fed. The term "tray" herein encompasses print media sheet trays in the form of drawers or removable cassettes for printers.

As to specific components of the subject apparatus or methods, or alternatives therefor, it will be appreciated that, as is normally the case, some such components are known per se in other apparatus or applications, which may be additionally or alternatively used herein, including those from art cited herein. For example, it will be appreciated by respective engineers and others that many of the particular component mountings or actuations illustrated herein are merely exemplary, and that the same novel motions and functions can be provided by other known or readily available alternatives. All cited references, and their references, are incorporated by reference herein where appropriate for teachings of additional or alternative details, features, and/or technical background. What is well known to those skilled in the art need not be re-described herein.

Various of the above-mentioned and further features and advantages will be apparent to those skilled in the art from the specific apparatus and its operation or methods described in the examples below, and the claims. Thus, they will be better understood from this description of these specific embodiments, including the drawing figures (which are approximately to scale) wherein:

FIG. 1, labeled "prior art," is a perspective view of a single stack edge guide also showing an exemplary sheet stack, which side guide can unlatch to move in one direction towards a stack edge by pushing on an upstanding latch releasing lever, but in order to move in the opposite direction to receive a large size paper stack requires a separate latch releasing pinching action coordinated together with a movement of the side guide in the direction opposite from the direction required to push on the latch releasing lever;

FIG. 2, labeled "prior art," is a side view of the FIG. 1 example, showing the unidirectional-only unlatching of that stack edge guide;

Figure 5:
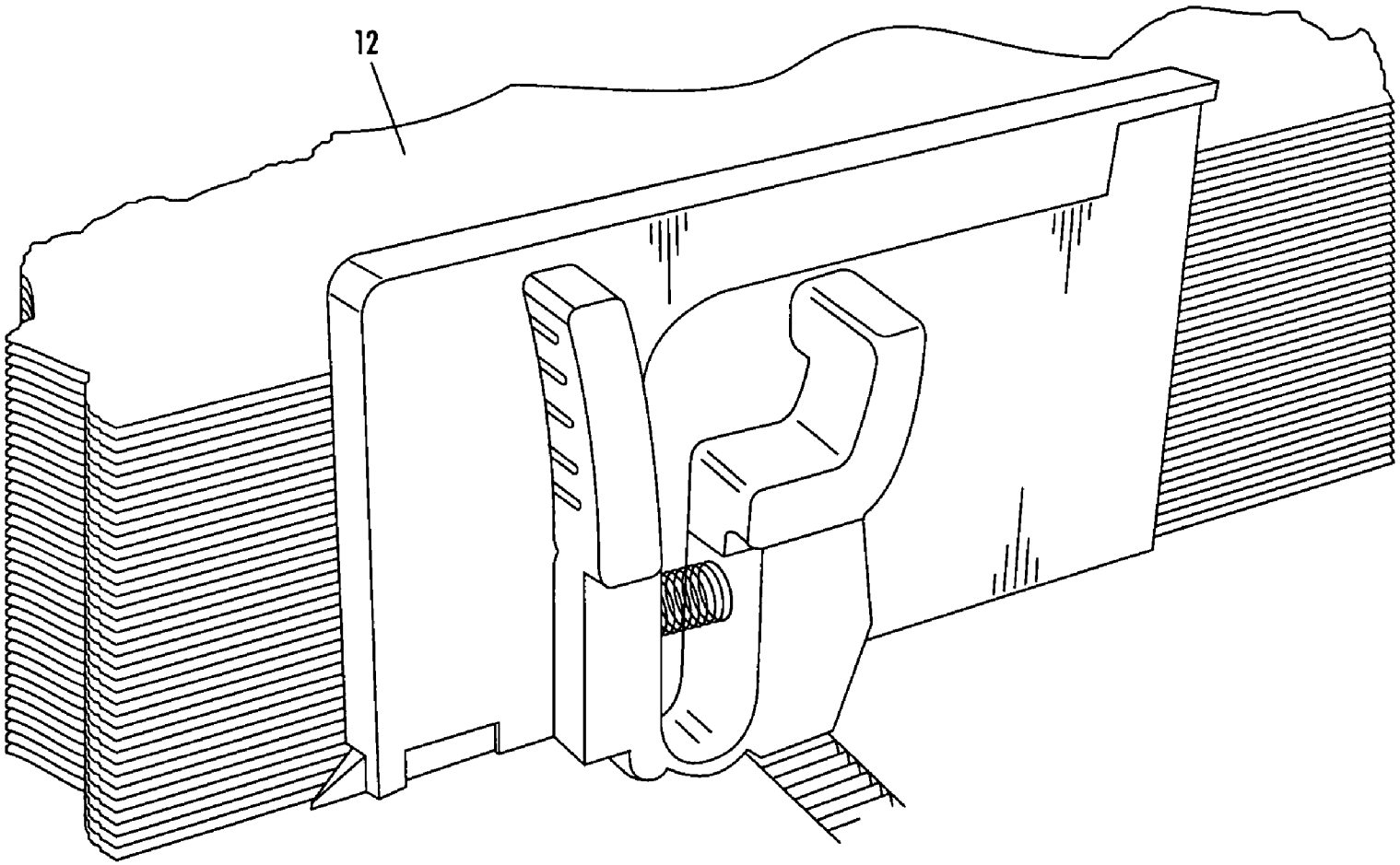
FIG. 5 PRIOR ART
Figure 6:
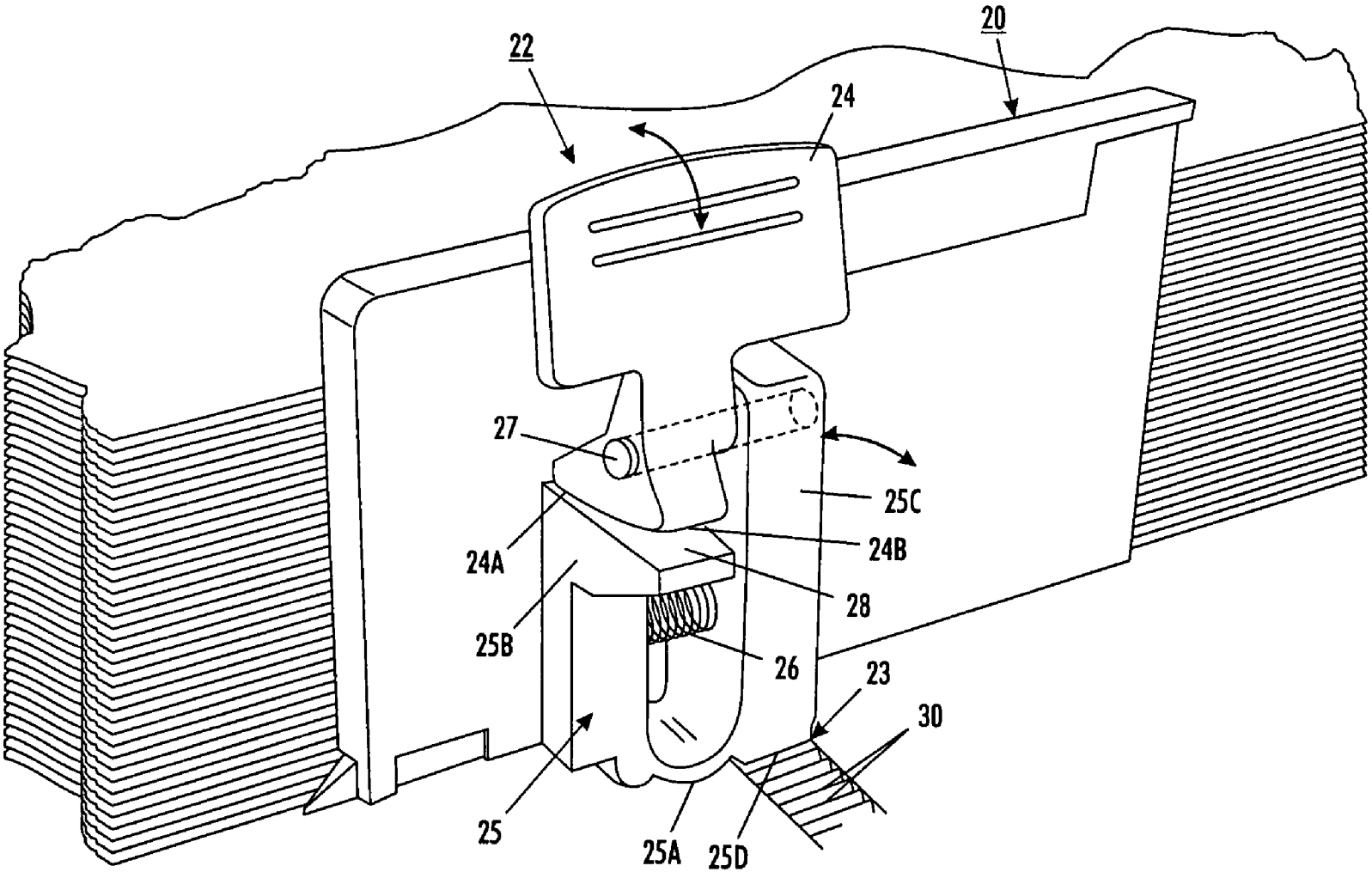

FIG. 5, labeled "prior art," is a perspective view of another stack edge guide which can only unlatch to move by a latch releasing pinching movement in only a single direction which is transversely of either of the needed directions of motion of the stack edge guide; and FIG. 6 is a perspective view of a second embodiment, a novel exemplary modification of the stack edge guide of FIG. 5, which provides simple integral latch releasing for stack edge guide repositioning movement in either desired direction by single direction movement in that desired direction of an upstanding latch releasing lever, possible with a single unidirectional finger movement.

Figure 1:
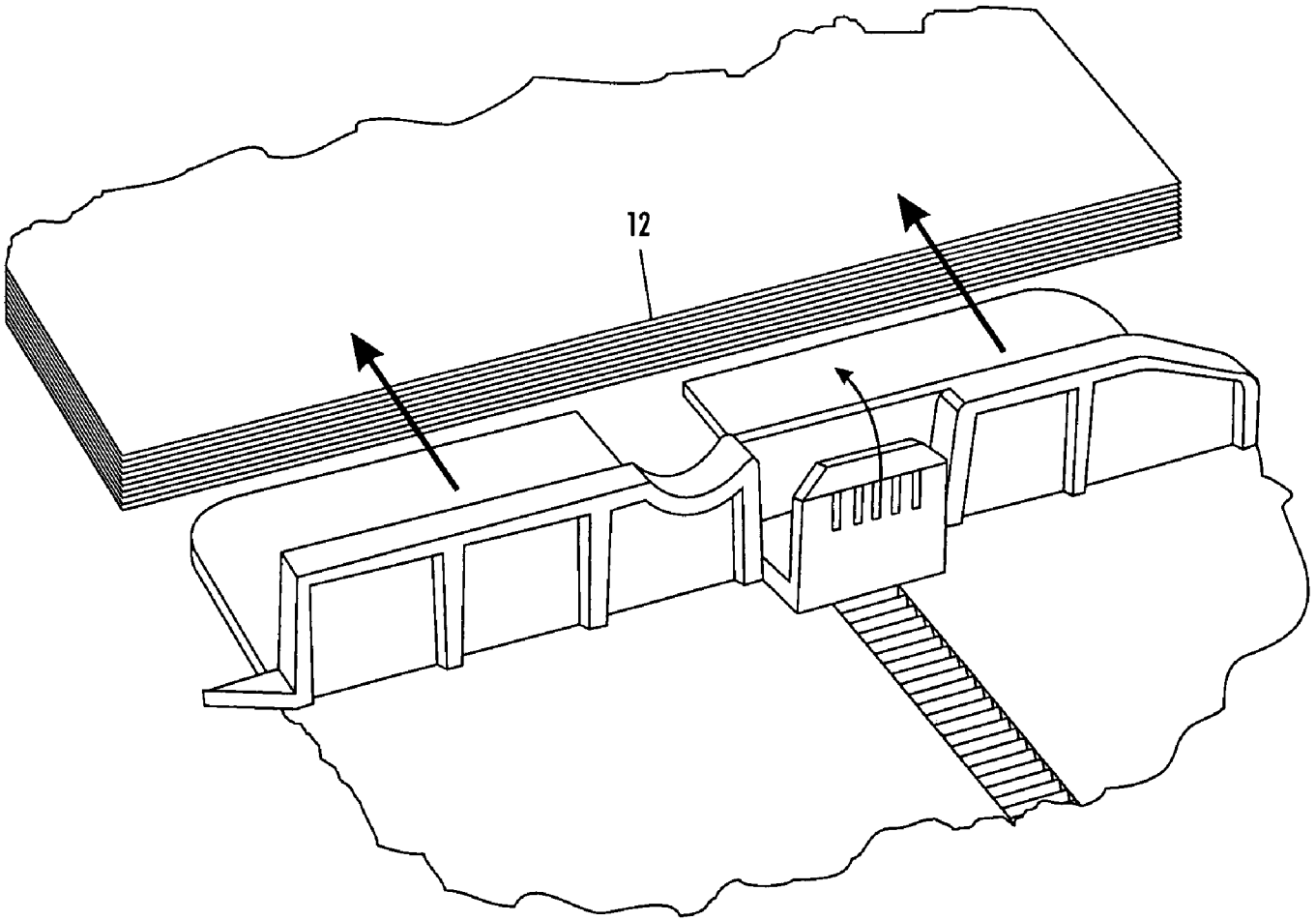
FIG. 1 PRIOR ART
Figure 2:
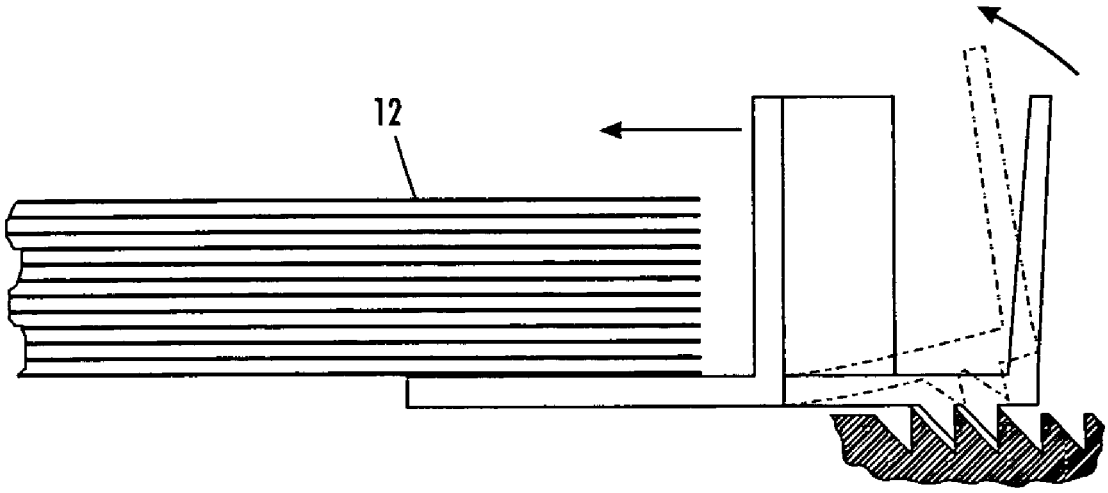
FIG. 2 PRIOR ART

By way of further background, adjusting paper trays for different sizes of print media, as in the prior art examples of FIGS. 1, 2 and 5 and the art cited above, often requires two simultaneous if not conflicting manual actions: pinching or squeezing a latch release actuator in one direction; and pushing and/or pulling the stack edge guide in a different desired repositioning movement direction. This relatively complex and unintuitive combined motions action may be particularly difficult for some people with limited manual dexterity. Yet stack edge guides without this complexity, such as those without positional latching, may not maintain their reset position reliably enough for certain paper feeding applications. In particular, stack side guides typically largely control and determine the initial lateral registration and skew of the sheets being fed from the stack thereof in the tray when properly positioned contacting or closely adjacent to the stack edges. The disclosed embodiments of FIGS. 3 and 4, and FIG. 6, retain an integral latching mechanism that automatically latches reliably yet unlatches to allow the guide to be moved in either direction by a simple manual pushing or pulling action in the same direction of movement as is then desired to reposition the stack edge guide. Yet when that pushing or pulling action is released, both of these embodiments provide automatic re-latching in the desired release position of the stack edge guide. Furthermore, as may be seen, many of the existing conventional latching system and stack edge guide components may be desirably retained and re-utilized therewith to reduce re-tooling and manufacturing costs for these disclosed embodiments.

Figure 3:
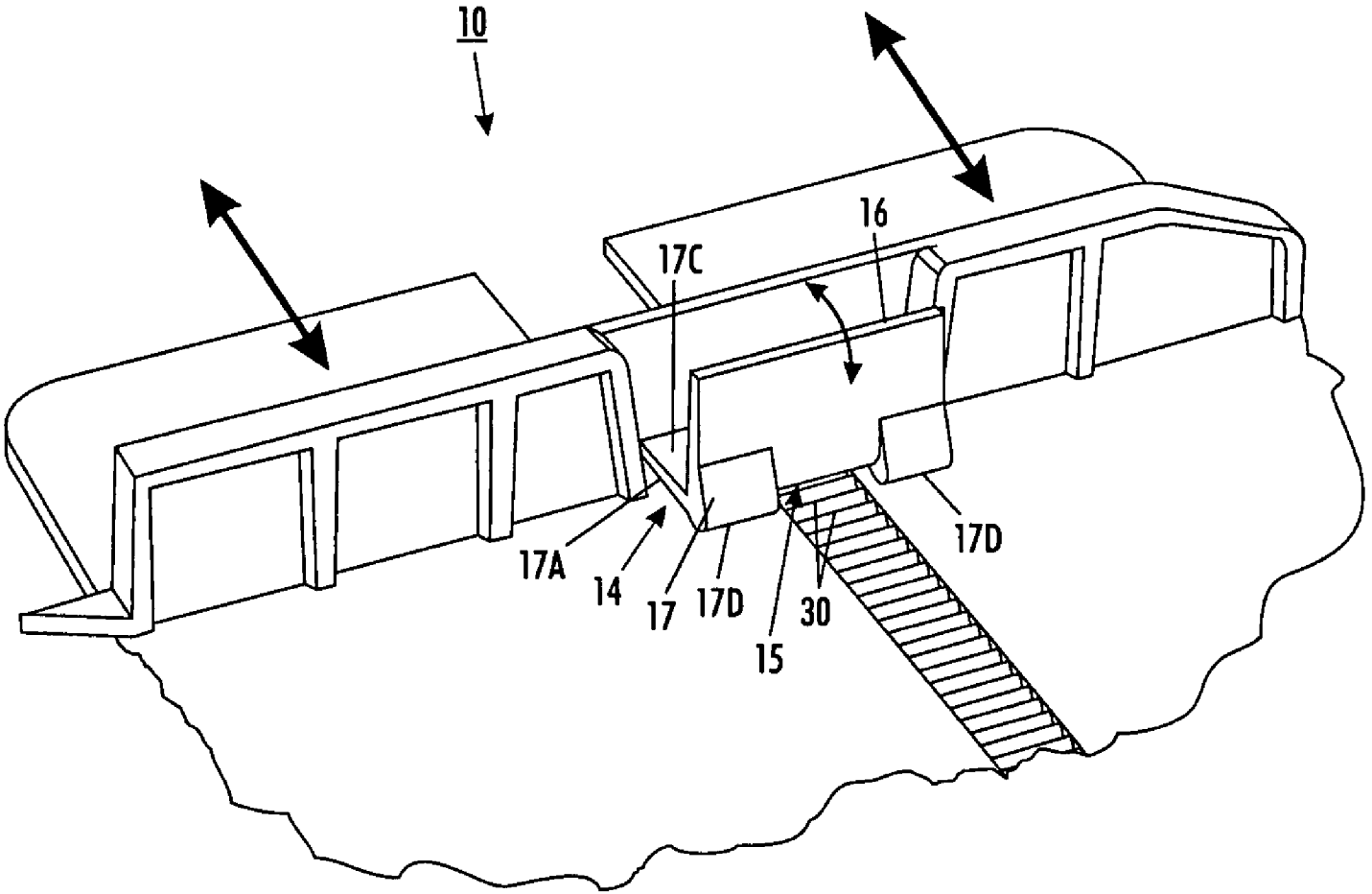
FIG. 3 is a perspective view of an embodiment of a novel exemplary modification of the stack edge guide of FIGS. 1 and 2 which provides simple integral latch releasing for stack edge guide repositioning movement in either desired direction by single direction movement in the desired direction of the upstanding latch releasing lever.
Figure 4:
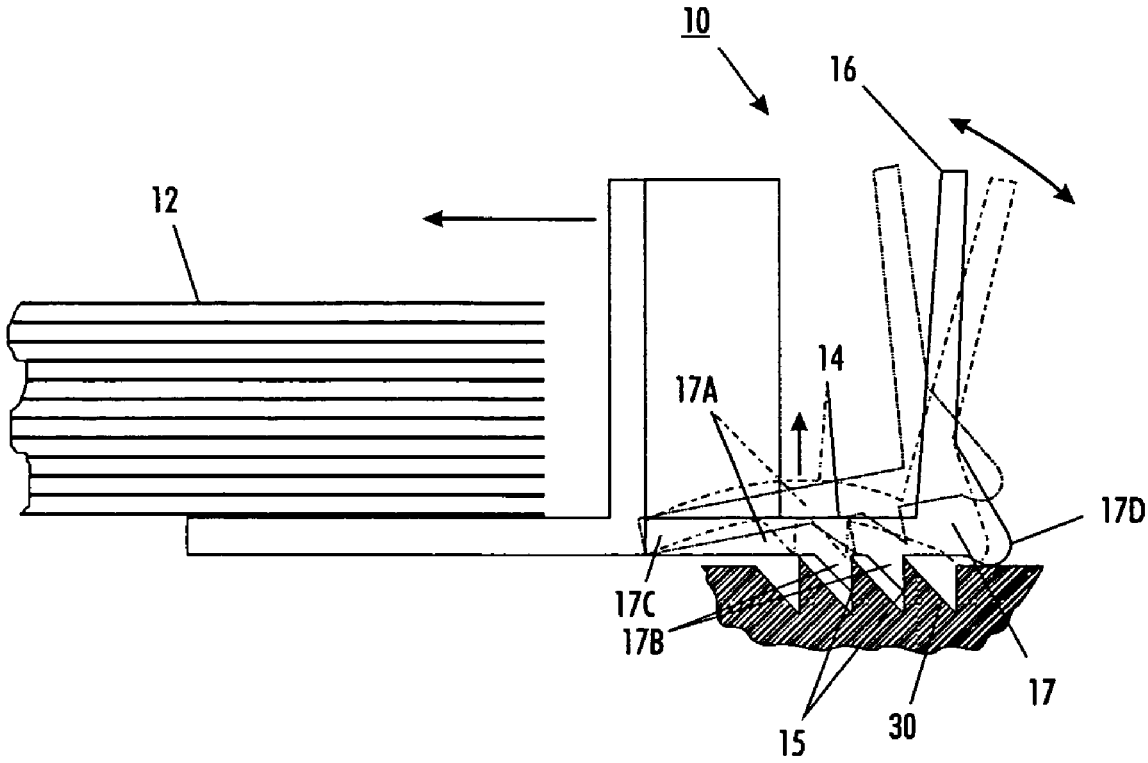
FIG. 4 is a side view of the example of FIG. 3 further illustrating the integral simplified pushing or pulling movement of that stack edge guide with integral bi-directional unlatching possible with a single finger movement of the upstanding latch releasing lever in the desired stack edge guide movement direction.

Describing now in further detail these two exemplary embodiments with reference to the Figures, there are shown here two different examples of a simple repositionable stack edge guide with the above-described and other advantages, numbered 10 in FIGS. 3 and 4, and 20 in FIG. 6. These stack edge guides 10 or 20 are easily manually repositionable in any of various sheet stacking trays to accommodate different sizes of print media sheet stacks 12, yet automatically latch in their desired re-set positions. Typically, as here, one or more stack edge guides 10 or 20 are linearly slide mounted on simple slide tracks on or under the sheet stacking tray surface [not relevant to this description because not requiring any modification, and variously shown in cited art] so as to be slidable towards at least one present print media sheet stack 12 edge position for sheets stacked in the tray, as shown in FIGS. 1 and 2, or bi-directionally slidable into new positions to receive therein a new stack of sheets of a different size.

Further, referring to FIGS. 3, 4 and 6, latching system 14 or 22 may be provided on or as a part of stack edge guides 10 or 20 for engaging and disengaging the stack edge guide from a selected latching position from among multiple different latching positions. A latching system may be typically provided, as in these examples, by engagement of a projecting latching engagement member 15 or 23 respectively, with an elongated toothed (or alternatively, apertured or frictional surface) track or rack 30 extending parallel to the slide tracks for the stack edge guide 10 or 20. The present system is applicable to many different such stack edge guide position latching systems.

Turning further to the subject improvements, the disclosed embodiments 10 and 20 provide automatic latching yet integrated manual latch releasing and movement of a movable sheet stack edge guide in a single simple and unidirectional manual movement which is in, and provides, the desired repositioning movement direction of stack edge guide 10 or 20 itself. There is in these examples an upstanding readily visible integral unlatching and movement actuating lever member 16 or 24, respectively, that can be operated even with a single movement of one finger to both release and move the sheet stack edge guide bi-directionally. This vertically extending member 16 or 24 can automatically unlatch the latching system 14 or 22 to move the edge guide 10 or 22 simply by pushing or pulling on it with a single finger in the desired movement direction. The member 16 or 24 pivots in that same direction to release the latch. No counterintuitive transverse or opposite direction squeezing or lifting movement is required for unlatching and movement. Thus, disclosed in both embodiments 10 and 20 is a mechanism that can latch a sheet stacking edge guide reliably in a desired position yet allow the guide to be moved in either direction to a new desired position by a simple unidirectional manual pushing action. The extending member 16 or 24 need only be partially pivotal through a small acute angle, or pivotal within effective such stop limits, such that additional manual force beyond a small force needed to for unlatching by such limited pivoting of that member 16 or 24 moves the stack edge guide 10 or 20 instead.

The exemplary sheet stack edge guide 10 mechanism of FIGS. 3 and 4, as particularly shown in FIG. 4, comprises an integral deformable plastic part 17 mounted to but extending from the rest of the stack edge guide 10 by a flexible extension 17A. This part 17 includes the upwardly extending actuator lever 16 at the other side of the flexible extension 17A. In the normal, un-actuated, solid line, position thereof teeth 17B extending downwardly intermediately of the flexible extension 17A engage underlying teeth on the toothed track or rack 30 to latch the stack edge guide 10 thereto in that position. Movement of the lever 16 in one direction—moving the guide 10 inwardly—causes pivotal flexure of the flexible extension 17A about its connection area 17C to the side guide 10 and thus lifting of the teeth 17B away from the track 30, to unlatch and allow movement of the side guide 10 in that same direction of lever 16 movement. Movement of the lever 16 in the opposite direction—to move the guide 10 Outwardly—causes (as shown in phantom) upward flexure of the flexible extension 17A about an integral pivot heel or pivot areas 17D at its outward end (under the lever 16) which is pivoting against the tray surface on opposite sides of the track 30 as shown in FIG. 2. That opposite lever 16 movement thus also lifts the teeth 17B away from the track 30, to also unlatch and allow movement of the side guide 10 in that opposite direction of lever 16 movement. When movement force is removed from the lever 16 the internal spring force in the flexible extension 17A returns itself and the lever 16 automatically to their normal positions, thus also re-inserting the teeth 17B down into track 30, to latch and prevent movement of the side guide 10 from its new position.

The other exemplary embodiment 20 of a repositionable stack edge guide shown in FIG. 6 is a modification of the prior art example of FIG. 5. As in FIG. 5 there is a "U" shaped member 25 with a thinner and flexible central or bottom interconnection, here 25A between a left side portion 25B integral the rest of the repositionable stack edge guide 20 and right side portion 25C that is not, and thus may be manually pinched pivotably towards the left side portion 25B. A spring 26 therebetween pushes the right side portion 25C away. This pushes down the bottom of the right side portion 25C, which pushes down its integral latching tab 25D into the tooth positional latching rack 30 on the stacking tray surface.

As modified in FIG. 6, a transverse pinching movement is no longer required to release this latching tab or latch engagement tab 25D to allow stack edge guide repositioning. An upstanding tabbed lever 24 is pivotally mounted by a pin 27 to right side portion 25C to be movable in either of the movement directions of the stack edge guide 20. The bottom of this lever 24 has two oppositely laterally extended camming edge surfaces 24A and 24B engageable with a fixed surface 28 added to the fixed left side portion 25B. Pushing the upstanding tabbed lever 24 in either of the two opposite movement directions of the stack edge guide 20 pivots it to force down one of the two camming surfaces 24A and 24B against the fixed surface 28. That lifts up its pin mounting 27, which lifts up its attached right side portion 25C, which lifts its integral latching tab or latch engagement tab 25D away from the latching rack 30. Thus allowing unlatched movement of the edge guide 20 in the same direction in which the lever 24 is being pushed or pulled.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. A stacking tray with plural latching positions for holding print media, said tray comprising:

at least one repositionable stack edge guide which is enabled to be repositionable in said tray in at least two opposite directions to accommodate different size print media, said stack edge guide is linearly slide mounted on slide track and enabled to be bi-directionally slidable into new positions to receive sheets of different sizes, said stack edge guide being an integral deformable plastic part comprising a vertical upstanding lever arm being pivotally mounted on said stack edge guide and being connected thereto a horizontal flexible extension and, said flexible extension (17A) having a lower latching engaging member with teeth extending downwardly therefrom, said teeth enabled to engage underlying teeth on a toothed track on said slide track, said slide track defined by an elongated array of said underlying teeth enabled to mate with said teeth of said latching engaging member, said upstanding lever arm is enabled to be manually movable to reposition said stack edge guide and is enabled to be manually movable in both of said opposite directions, said flexible extension (17A) because it is a deformable plastic part and having thereby an internal spring force, enabled to return itself and said lever arm automatically to their normal positions and wherein said latching engaging member is enabled to be lifted away from said slide track by pivoting of said upstanding lever arm when said upstanding lever arm is manually moved in either of said two opposite directions, positioned below and integral with said lever arm are two spaced apart pivot heels configured to contact a bottom portion of said tray and having said lower latching engaging member therebetween, said latching engaging member comprising said teeth enabled to engage and be removed from said underlying teeth on said toothed track.

2. The stacking tray of claim 1 comprising:

at least one said repositionable stack edge guide, wherein said plural latching positions are defined by an elongated array of multiple spaced latches, at least one of which is normally engaged by one of side teeth on said latching engaging member, and wherein said vertically upstanding lever arm is pivotally mounted to said horizontal flexible extension.

3. The print media sheet stacking tray of claim 1 comprising:

at least one said repositionable stack edge guide, wherein said upstanding lever arm has located in its lower portion said two different spaced apart flexible pivot heels which are enabled with said lower latching engaging member positioned therebetween to unlatch said repositionable stack edge guide in both of said two opposite movement directions with a same manual pivoting movement of said upstanding lever arm.

* * * * *